US007595762B2

(12) United States Patent
Mansour

(10) Patent No.: US 7,595,762 B2
(45) Date of Patent: Sep. 29, 2009

(54) LOW PROFILE ANTENNA

(75) Inventor: David Mansour, Haifa (IL)

(73) Assignee: Starling Advanced Communications Ltd., Yoqneam (IL)

( * ) Notice: Subject to any disclaimer, the term of this patent is extended or adjusted under 35 U.S.C. 154(b) by 153 days.

(21) Appl. No.: 11/580,306

(22) Filed: Oct. 13, 2006

(65) Prior Publication Data

US 2007/0146222 A1 Jun. 28, 2007

(30) Foreign Application Priority Data

Oct. 16, 2005 (IL) ..... 171450

(51) Int. Cl.
*H01Q 3/00* (2006.01)
*H01Q 21/00* (2006.01)
*H01Q 3/02* (2006.01)

(52) U.S. Cl. ..... 343/757; 343/879; 343/882; 343/766

(58) Field of Classification Search ..... 343/711, 343/757, 765, 766, 853, 879, 882
See application file for complete search history.

(56) References Cited

U.S. PATENT DOCUMENTS

| | | | |
|---|---|---|---|
| 3,810,185 | A | 5/1974 | Wilkinson |
| 4,263,598 | A | 4/1981 | Bellee et al. |
| 4,486,758 | A | 12/1984 | de Ronde |
| 4,527,165 | A | 7/1985 | de Ronde |
| 4,614,947 | A | 9/1986 | Rammos |
| 4,647,938 | A | 3/1987 | Roederer et al. |
| 4,679,051 | A | 7/1987 | Yabu et al. |
| 4,801,943 | A | 1/1989 | Yabu et al. |
| 5,089,824 | A | 2/1992 | Uematsu et al. |
| 5,245,348 | A | 9/1993 | Nishikawa et al. |
| 5,309,162 | A | 5/1994 | Uematsu et al. |
| 5,398,035 | A | 3/1995 | Densmore et al. |
| 5,404,509 | A | 4/1995 | Klein |
| 5,420,598 | A | 5/1995 | Uematsu et al. |
| 5,508,731 | A | 4/1996 | Kohorn |
| 5,528,250 | A | 6/1996 | Sherwood et al. |
| 5,537,141 | A | 7/1996 | Happer et al. |
| 5,544,299 | A | 8/1996 | Wenstrand et al. |
| 5,579,019 | A | 11/1996 | Uematsu et al. |
| 5,596,336 | A | 1/1997 | Liu |
| 5,678,171 | A | 10/1997 | Toyama et al. |

(Continued)

FOREIGN PATENT DOCUMENTS

EP 0 546 513 A1 6/1993

(Continued)

OTHER PUBLICATIONS

Mr-Live "Mr-Live—Take the Pulse of Your Market", Product Overview, 11 P., 2001.

(Continued)

*Primary Examiner*—Shih-Chao Chen
(74) *Attorney, Agent, or Firm*—Nixon & Vanderhye PC

(57) ABSTRACT

Plural panelized phased arrays, possibly including electronic tilt, are controlled in physical orientation to present a reduced physical profile. Each panel may include a non-linear shaped aperture which physically mates with other shaped apertures to maintain a composite tapered aperture for reduced side lobes. Long delay compensation to equalize RF radiator element signal propagation times improves bandwidth.

35 Claims, 11 Drawing Sheets

U.S. PATENT DOCUMENTS

| | | | |
|---|---|---|---|
| 5,712,644 | A | 1/1998 | Kolak |
| 5,740,035 | A | 4/1998 | Cohen et al. |
| 5,751,247 | A | 5/1998 | Nomoto et al. |
| 5,764,199 | A | 6/1998 | Ricardi |
| 5,767,897 | A | 6/1998 | Howell |
| 5,781,163 | A | 7/1998 | Ricardi et al. |
| 5,799,151 | A | 8/1998 | Hoffer |
| 5,801,754 | A | 9/1998 | Ruybal et al. |
| 5,823,788 | A | 10/1998 | Lemelson et al. |
| 5,841,980 | A | 11/1998 | Waters et al. |
| 5,861,881 | A | 1/1999 | Freeman et al. |
| 5,872,545 | A | 2/1999 | Rammos |
| 5,878,214 | A | 3/1999 | Gilliam et al. |
| 5,880,731 | A | 3/1999 | Liles et al. |
| 5,886,671 | A | 3/1999 | Riemer et al. |
| 5,916,302 | A | 6/1999 | Dunn et al. |
| 5,917,310 | A | 6/1999 | Baylis |
| 5,929,819 | A | 7/1999 | Grinberg |
| 5,961,092 | A | 10/1999 | Coffield |
| 5,978,835 | A | 11/1999 | Ludwig et al. |
| 5,982,333 | A | 11/1999 | Stillinger et al. |
| 5,983,071 | A | 11/1999 | Gagnon et al. |
| 5,991,595 | A | 11/1999 | Romano et al. |
| 5,995,951 | A | 11/1999 | Ferguson |
| 5,999,208 | A | 12/1999 | McNerney et al. |
| 6,049,306 | A | 4/2000 | Amarillas |
| 6,061,082 | A | 5/2000 | Park |
| 6,061,440 | A | 5/2000 | Delaney et al. |
| 6,061,716 | A | 5/2000 | Moncreiff |
| 6,064,978 | A | 5/2000 | Gardner et al. |
| 6,074,216 | A | 6/2000 | Cueto |
| 6,078,948 | A | 6/2000 | Podgorny et al. |
| 6,120,534 | A | 9/2000 | Ruiz |
| 6,124,832 | A | 9/2000 | Jeon et al. |
| 6,160,520 | A | 12/2000 | Muhlhauser et al. |
| 6,169,522 | B1 | 1/2001 | Ma et al. |
| 6,184,828 | B1 | 2/2001 | Shoki |
| 6,191,734 | B1 | 2/2001 | Park et al. |
| 6,204,823 | B1 | 3/2001 | Spano et al. |
| 6,218,999 | B1 | 4/2001 | Bousquet et al. |
| 6,249,809 | B1 | 6/2001 | Bro |
| 6,256,663 | B1 | 7/2001 | Davis |
| 6,259,415 | B1 | 7/2001 | Kumpfbeck et al. |
| 6,297,774 | B1 | 10/2001 | Chung |
| 6,304,861 | B1 | 10/2001 | Ferguson |
| 6,331,837 | B1 | 12/2001 | Shattil |
| 6,347,333 | B2 | 2/2002 | Eisendrath et al. |
| 6,407,714 | B1 | 6/2002 | Butler et al. |
| 6,442,590 | B1 | 8/2002 | Inala et al. |
| 6,483,472 | B2 | 11/2002 | Cipolla et al. |
| 6,486,845 | B2 | 11/2002 | Ogawa et al. |
| 6,496,158 | B1 | 12/2002 | Ksienski et al. |
| 6,578,025 | B1 | 6/2003 | Pollack et al. |
| 6,657,589 | B2 | 12/2003 | Wang et al. |
| 6,661,388 | B2 | 12/2003 | Desargant et al. |
| 6,677,908 | B2 | 1/2004 | Strickland |
| 6,707,432 | B2 | 3/2004 | Strickland |
| 6,738,024 | B2 | 5/2004 | Butler et al. |
| 6,765,542 | B2 | 7/2004 | McCarthy et al. |
| 6,771,225 | B2 | 8/2004 | Tits |
| 6,778,144 | B2 | 8/2004 | Anderson |
| 6,792,448 | B1 | 9/2004 | Smith |
| 6,839,039 | B2 * | 1/2005 | Tanaka et al. ..... 343/824 |
| 6,861,997 | B2 | 3/2005 | Mahon |
| 6,864,837 | B2 | 3/2005 | Runyon et al. |
| 6,864,846 | B2 | 3/2005 | King |
| 6,873,301 | B1 | 3/2005 | Lopez |
| 6,897,806 | B2 | 5/2005 | Toshev |
| 6,950,061 | B2 | 9/2005 | Howell et al. |
| 6,999,036 | B2 | 2/2006 | Stoyanov et al. |
| 7,061,432 | B1 * | 6/2006 | Tavassoli Hozouri . 343/700 MS |
| 7,385,562 | B2 | 6/2008 | Stoyanov et al. |
| 2001/0026245 | A1 | 10/2001 | Cipolla et al. |
| 2002/0072955 | A1 | 6/2002 | Brock |
| 2002/0128898 | A1 | 9/2002 | Smith et al. |
| 2002/0194054 | A1 | 12/2002 | Frengut |
| 2003/0088458 | A1 | 5/2003 | Afeyan et al. |
| 2003/0122724 | A1 | 7/2003 | Shelley et al. |
| 2004/0178476 | A1 | 9/2004 | Brask et al. |
| 2004/0233122 | A1 | 11/2004 | Espenscheid et al. |
| 2005/0057396 | A1 | 3/2005 | Boyanov |
| 2005/0146473 | A1 | 7/2005 | Stoyanov et al. |
| 2005/0259021 | A1 | 11/2005 | Stoyanov et al. |
| 2006/0197713 | A1 | 9/2006 | Mansour et al. |
| 2006/0244669 | A1 | 11/2006 | Mansour et al. |
| 2007/0085744 | A1 | 4/2007 | Engel |

FOREIGN PATENT DOCUMENTS

| | | | |
|---|---|---|---|
| EP | 0 557 853 | A1 | 9/1993 |
| JP | 62-173807 | | 7/1987 |
| JP | 63-108805 | | 5/1988 |
| JP | 06-3174411 | | 7/1988 |
| JP | 2-137402 | | 5/1990 |
| JP | 3-247003 | | 11/1991 |
| JP | 6-69712 | | 3/1994 |
| JP | 06-237113 | | 8/1994 |
| JP | 8-321715 | | 12/1996 |
| WO | 89/09501 | | 10/1989 |
| WO | 00/75829 | | 12/2000 |
| WO | WO 01/11718 | A1 | 2/2001 |
| WO | 01/84266 | | 11/2001 |
| WO | 02/19232 | | 3/2002 |
| WO | 02/057986 | | 7/2002 |
| WO | 02/103842 | | 12/2002 |
| WO | WO 02/097919 | A1 | 12/2002 |
| WO | 03/052868 | | 6/2003 |
| WO | 03/096576 | | 11/2003 |
| WO | 2004/042492 | | 5/2004 |
| WO | 2004/079859 | | 9/2004 |
| WO | 2004/079861 | | 9/2004 |
| WO | WO 2004/075339 | A2 | 9/2004 |
| WO | 2004/097972 | | 11/2004 |
| WO | 2005/004284 | | 1/2005 |
| WO | WO 2005/067098 | A1 | 7/2005 |
| WO | 2007/046055 | | 4/2007 |
| WO | 2007/063434 | | 6/2007 |

OTHER PUBLICATIONS

NetOnCourse "Harnessing the Value of Mass E-Gathering", <www.netoncourse.com>, 12 p., 2000.

NetONCourse "NetOnCourse. Masters of Future Think", 4 p, No Date.

International Search Report mailed Oct. 14, 2004 in International Application No. PCT/IL04/00149.

International Search Report mailed Apr. 20, 2005 in International Application No. PCT/IL2005/000020.

Supplementary European Search Report completed Dec. 23, 2005 in European Application No. EP 04 71 2141.

European Patent Office Communication dated Oct. 4, 2006 in European Application No. EP 04 712 141.3.

Notification of Transmittal of International Preliminary Report on Patentability mailed May 27, 2005 in International Application No. PCT/IL04/00149.

Declaration of Messrs. Micha Lawrence and David Levy (Jan. 10, 2006) Including Exhibits re Sep. 9-12, 2003 Public Display in Seattle, Washington, USA.

Ito et al., "A Mobile 12 GHZ DBS Television Receiving System," IEEE Transactions on Broadcasting, vol. 35, No. 1, Mar. 1989, pp. 56-62.

Peeler et al., "A Two-Dimensional Microwave Luneberg Lens," I.R.E Transactions—Antennas and Propagation, Jul. 1953, pp. 12-23.

Peeler et al., "Microwave Stepped-Index Luneberg Lenses," IRE Transactions on Antennas and Propagation, Apr. 1958, pp. 202-207.

Peeler et al., "Virtual Source Luneberg Lenses," I-R-E Transactions—Antennas and Propagation, Jul. 1954, pp. 94-99.

Felstead, "Combining Multiple Sub-Apertures for Reduced-Profile Shipboard Satcom-Antenna Panels," IEEE, Milcom 2001 Proceedings, Communications for Network-Centic Operations: Creating the Information Force, Oct. 28-30, 2001, XP010579091, pp. 665-669.

Office Action dated Feb. 5, 2009, re U.S. Appl. No. 11/477,600.

Office Action dated Feb. 24, 2009, re U.S. Appl. No. 11/440,054.

Response dated Mar. 3, 2008, to Search Report and Written Opinion dated Oct. 9, 2007, from the International Searching Authority re PCT/IB2006/053806.

Response dated Jul. 14, 2008, to the communication Pursuant to Rules 161 and 162 EPC dated May 26, 2008, from the EPO re EP 06809614.8.

Response dated Sep. 22, 2008, to the Communication Pursuant to Article 94(3) EPC dated Aug. 25, 2008, from the EPO re EP 06809614.8.

Response dated Mar. 23, 2009, to Office Action dated Feb. 24, 2009, re U.S. Appl. No. 11/440,054.

English Translation of Notification of Reasons of Rejection dated Jan. 21, 2009, from JPO re JP 2006-502642.

Levine, et al., "Component Design Trends — Dual-Mode Horn Feed for Microwave Multiplexing," *Electronics*, vol. 27, pp. 162-164 (Sept. 1954).

Stuchly, et al., "Wide-Band Rectangular to Circular Waveguide Mode and Impedance Transformer," *IEEE Transactions on Microwave Theory and Techniques*, vol. 13, pp. 379-380 (May 3, 1965).

* cited by examiner

Splitting Antenna into Plural Panels at Possibly Different Heights

LOW PROFILE ANTENNA

CROSS-REFERENCES TO RELATED APPLICATIONS

This application claims priority from Israeli application IL 171,450 filed Oct. 16, 2005 and is related to U.S. patent application Ser. No. 10/546,264, filed Aug. 18, 2005, which is a national phase of PCT application PCT/IL2004/000149, filed Feb. 18, 2004 and published as WO 2004/075339, the dislosures of which are hereby incorporated by reference. This application is also related to copending divisional application 11/477,600 filed Jun. 30, 2006 for the purpose of provoking interference with U.S. Pat. No. 6,999,036 and published application 2005/0259021 A1. This application is also related to copending application Ser. No. 11/440,054 directed to exemplary individual radiator elements of a type may be used on the antenna panels described herein.

TECHNICAL FIELD

This application relates to antennas and particularly to low profile phased array RF antennas having plural phased sub-arrays of RF radiator elements, the sub-arrays being physically moveable to change the pointing direction of a radiation pattern lobe (which pointing direction may also be subject to electronic tilting).

BACKGROUND

One method of providing broadband communication services onboard moving vehicles (e.g., airplanes, trains, cars, buses, trucks, ships, etc.) is by communicating with a base station through RF transceivers on one or more earth satellites. For example, an antenna on the vehicle directed at the satellite may receive signals from the satellite. However, antennas externally mounted on vehicles moving in an ambient fluid (e.g., air) preferably have a low profile to minimize drag forces which slow vehicle motion and/or require extra motive power.

One approach (e.g., see earlier related application Ser. No. 10/546,264 referenced above) to achieving a low profile antenna is to use a plurality of arrayed antennas (including separately positioned sub-array components), each antenna being smaller (i.e., lower in profile) than a single antenna (or sub-array) with equivalent gain. A similar approach is described in U.S. Pat. No. 6,999,036 to Stoyanov et al. (the disclosure of which is hereby incorporated by reference) including the possibility of using electronic beam steering to supplement mechanical steering.

U.S. Pat. No. 5,678,171 to Toyama et al., the disclosure of which is hereby incorporated by reference, also describes use of a plurality of antenna arrays on an airplane. Using a plurality of antenna arrays rather than a single antenna, reduces the profile of the total antenna structure extending externally of the airplane for a given antenna gain. A similar approach is described in U.S. Pat. No. 4,679,051 to Yabu et al., the disclosure of which is hereby incorporated by reference.

U.S. Pat. No. 5,309,162 to Uematsu et al., the disclosure of which is hereby incorporated by reference, also describes use of two parallel antenna panels fixed with respect to each other but controllably rotatable together about azimuth and elevation axes. U.S. Pat. No. 6,657,589 to Wang et al., the disclosure of which is hereby incorporated by reference, also describes a low profile satellite antenna, which includes a pair of antenna assemblies.

Another approach used in the past to reduce antenna profile is to make a phased array antenna with an RF radiation pattern principal lobe beam direction not perpendicular (i.e., "tilted" at an acute angle) to the surface of the antenna array aperture. See, for example, the embodiments of FIGS. 6A-C in U.S. Pat. No. 6,999,036 to Stoyanov et al. noted above where electronic tilt is applied to each of plural antenna sub-arrays.

U.S. Pat. No. 6,259,415 to Kumpfbeck et al., the disclosure of which is hereby incorporated herein by reference, suggests a different approach, in which a single flat antenna panel (of arrayed elemental RF radiators) is used. In the Kumpfbeck antenna, the antenna beam is electronically fixed at an acute angle (e.g., 45°) relative to the antenna panel radiating surface. Thus, instead of requiring a 70° physical tilt of the antenna array panel (e.g., downward in elevation from a vertical orientation) in order to communicate with a satellite at a 20° elevation angle, a physical downward tilt of only 25° is sufficient.

U.S. Pat. No. 6,191,734 to Park et al., the disclosure of which is hereby incorporated by reference, describes an array of flat sub-array antenna panels, which have an electronic beam tilt control, such that instead of mechanically changing the elevation view direction of the panels, their beam direction is adjusted (i.e., tilted) electronically.

U.S. Pat. No. 6,864,837 to Runyon et al., the disclosure of which is incorporated by reference, describes a vertical antenna for base stations that implements electrical down tilt. Here the electrical tilt is used for purposes different than reducing antenna profile.

U.S. Pat. No. 6,873,301 to Lopez, the disclosure of which is hereby incorporated by reference, describes a flat antenna utilizing an array of sub-arrays contiguously positioned in a diamond-type pattern. This layout is claimed to achieve lower side lobes.

BRIEF SUMMARY

1. Panel Array with Electronic Tilt

In some exemplary embodiments, a controller controls the panels to present an apparently continuous surface over a range of beam direction angles (including use of electronic tilt), which includes angles in which the beam directions of the panels and a perpendicular to the panels are in different quadrants (i.e., separated by more than 90°). In such a configuration, the beam may actually be pointed towards a satellite viewed at a low elevation angle (e.g., 5, 10 or 15 degrees) while the panel appears to be directed almost vertically (i.e., presenting a very low profile).

In some embodiments, for some beam directions of the antenna (e.g., low orbit beam directions), some overlap of the panels in the beam direction is allowed, for example, by limiting the maximal allowed variable distance between adjacent panels.

Preferably, the panels maintain an apparently continuous surface (as viewed from the beam pointing direction) by adjusting the horizontal distance between edges of adjacent panels. However, in some embodiments, for at least some beam direction angles, the horizontal distance between adjacent panels is negative, i.e., the panels partially overlap from a vertical perspective. The term vertical overlap refers herein to a situation in which a straight line perpendicular to a nominally horizontal antenna base intersects two panels.

The electronic tilt of the antenna panels is in some embodiments fixed by the panel configuration of radiators and feed-line (phase-shift) network on the panel or associated with the panel. In other embodiments, the electronic tilt of the panels can be controllably configurable, for example, according to the satellites with which the antenna is to communicate and/or the bandwidths of the communicated signals. In still other embodiments, the electronic "analog" tilt (i.e., electronically adjustable even if achieved in digitized increments) of the panels can be dynamically adjusted by the controller (e.g., by adjusting the relative feedline phasing of RF signals to/from RF radiator elements in each sub-array panel).

2. Panel Assembly with Fixed Physically Built-in "Digital" Tilt

An aspect of some exemplary embodiments relates to an antenna panel assembly including at least a pair of assemblies, each assembly having at least two sub-panels in different planes, which sub-panels are physically fixed relative to each other such that they move (e.g., rotate) together. The aforementioned U.S. Pat. No. 5,309,162 to Uematsu uses a single similar assembly structure. This may be referred to as a "digital" tilt to signify its fixed non-adjustable nature. The sub-panels of such assemblies also may have an electronic tilt such that their respective beam directions are not perpendicular to the associated sub-panel.

The sub-panels of each assembly may be optionally fixed together such that the sub-panels, when viewed from their common beam direction angle (possibly including electronic tilt), preferably present an apparently continuous surface without overlap or gaps. A plurality of sub-panel assemblies, each with digital tilt, are preferably controlled (i.e., by a programmed controller) to move relative to each other over a range of beam directions, such that all panels and/or sub-panels present an apparently continuous surface when viewed from the radiation pattern beam pointing direction. Using such an arrangement of plural sub-panel assemblies provides a choice of the fixed relationship (i.e., digital tilt) between the panels of a given sub-panel assembly so as to optimize operation over a given range of beam directions.

3. Panels of Different Heights and/or Thicknesses

An aspect of some embodiments relates to a multi-panel antenna, in which the beam direction of the panels may be mechanically controlled by a controller such that the beam pointing directions are substantially always parallel even though the upper surfaces of the antenna panels may be placed at different heights (e.g., vertically above a base mount), such that a lower panel does not block a higher panel.

In some embodiments, such panels may have the same thickness. A higher positioned panel may allow placement of some antenna control apparatus beneath that panel. Alternatively, the panels may have different thicknesses, for example, a panel with a higher upper surface may be thicker.

4. Elliptical/Oval Shaped Panel Array(s)

An aspect of some embodiments relates to an array of flat antenna panels which are shaped to border each other along non-straight (i.e., non-linear) border lines. The use of non-straight borders between the panels was found to reduce side lobes in the array radiation pattern for signals transmitted and/or received via the antenna.

In some embodiments, such antenna panels may be moveable relative to each other, but controlled so that over a range of beam pointing direction angles they appear to form a continuous surface, without gaps or overlay, when viewed from the beam pointing direction. In other embodiments, at least some antenna panels may be fixed relative to each other.

In some embodiments, the antenna panels may comprise a first panel having a generally elliptical or oval shape and at least one second panel (e.g., of a generally banana or crescent-shape) which completes, with the first panel (and possibly other similarly shaped second panels), a larger generally elliptical or oval shape.

5. Delay Correction for Antenna

An aspect of some embodiments relates to an antenna formed of one or more phased array multi-element panels, in which a time delay can be electronically added to the RF signal(s) associated with each element of the array, such that the arrival time of signals from (or to) a remote source, together with the added delays, are substantially the same for all elements. Adding entire delay compensation values rather than compensating only for desired relative element phasing helps reduce signal error, (e.g., to achieve wider frequency bandwidth as required in TV reception), although slightly adding to the delay of signals passing via the antenna.

BRIEF DESCRIPTION OF THE DRAWINGS

Particular non-limiting exemplary embodiments will be described in conjunction with the accompanying Figures. Identical structures, elements or parts which appear in more than one Figure are preferably labeled with a same or similar number in all the Figures in which they appear, in which.

DETAILED DESCRIPTION OF EXEMPLARY EMBODIMENTS

Figure 1:
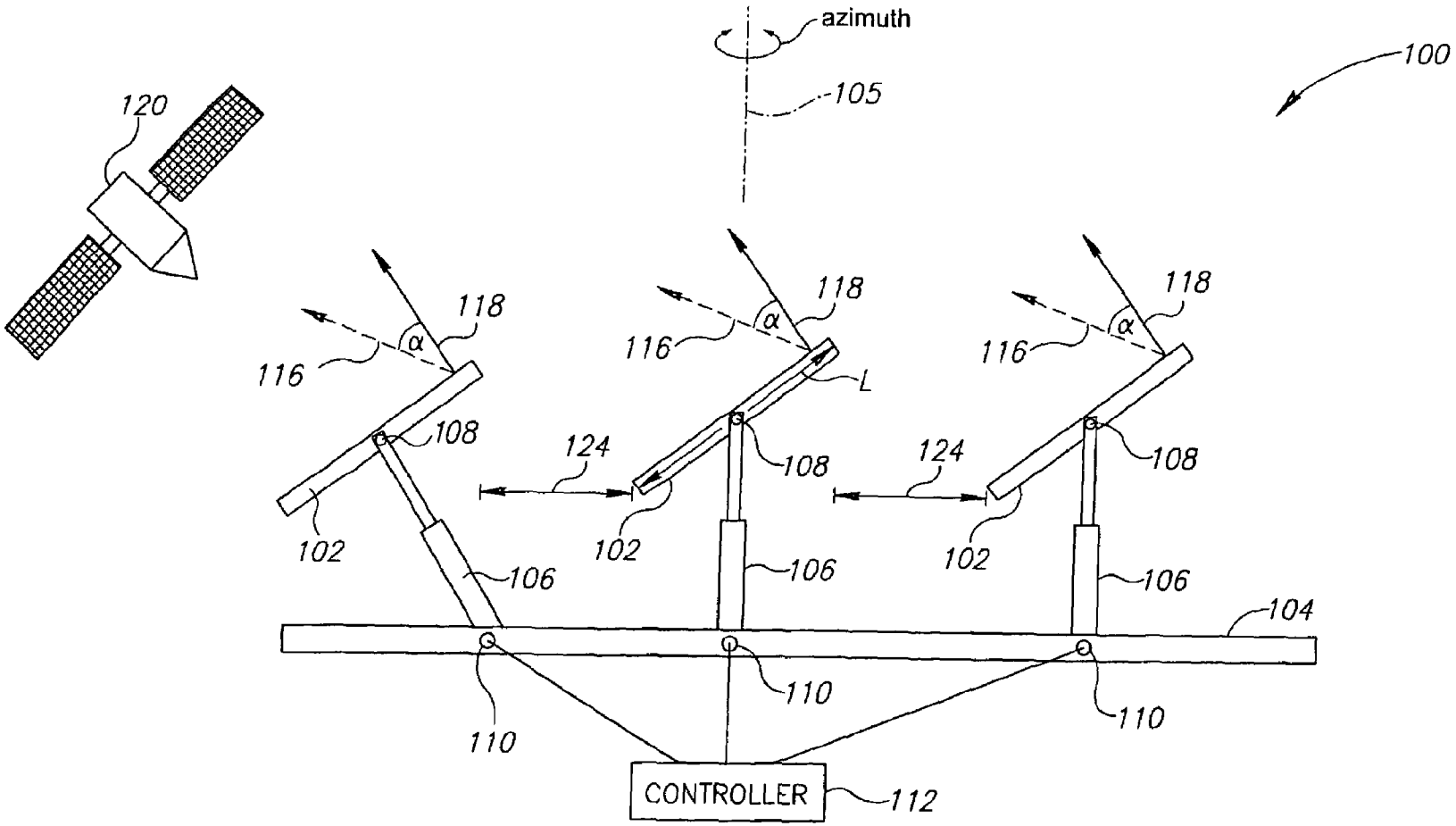
FIG. 1 is a schematic side view of an antenna, in accordance with one exemplary embodiment.

FIG. 1 is a schematic side view of an antenna 100, in accordance with an exemplary embodiment. Antenna 100 includes a plurality of flat panels 102, each including respective phased arrays of individual antenna RF radiator element. Panels 102 are optionally mounted on a rotatable base 104, which is used to rotate panels 102 about axis 105 in azimuth toward a satellite 120 (e.g., using suitable electromechanical transducers, feedback control systems and the like as will be apparent to those in the art). Panels 102 are optionally mounted on base 104 via respective arms 106 pivoted at 110.

In some embodiments, panels 102 have a beam pointing direction 116 which is not perpendicular to the panel, but rather is at a tilt angle $\alpha$ from a line 118 that is perpendicular to the panel (direction 118 being the nominal beam pointing angle without electronic tilt). The tilt angle $\alpha$ is optionally achieved by providing feedlines to antenna elements at different locations on panels 102 with different respective relative signal phases and/or time delays (e.g., to achieve a broadband frequency response) as is known in the art. Alternatively or additionally, any other methods of achieving a tilt angle may be used. Using a beam pointing direction 116 with a tilt relative to the perpendicular axis or broadside direction 118 of the panel, allows directing the panel toward satellite 120 at lower elevational angles, while maintaining panels 102 at a lower vertical profile or height relative to a moving vehicle on which the panels are mounted.

Panels 102 are optionally movable relative to each other, under control of a controller 112. In some embodiments, panels 102 are rotatably mounted on arms 106, such that panels 102 may be controllably rotated around at least one axis at respective pivot points 108 and/or 110, to adjust their respective elevation angles $\phi$ and/or horizontal/vertical separations. It will be understood that elevation angle $\phi$ is typically measured from a horizontal (or vertical)—which may or may not coincide with the orientation of base 104 (or a perpendicular thereto). As already noted, arms 106 may be rotatably mounted on base 104, such that the arms can also controllably rotate around at least one axis at respective pivot points 110. If the arms 106 are separately rotatable about their respective axes 110, then controller 112 adjusts the respective angles of arms 106 in order to adjust horizontal (and vertical) distances between panels 102 (e.g., so as to maintain a substantially continuous apparently contiguous projection of the panels with respect to each other when viewed from the beam pointing direction). Suitable conventional electromechanical transducers and associated mechanical linkage (and servo-controlled feedback systems) may be used to achieve such controllable rotational motions as will be appreciated by those in the art.

Alternatively or additionally to arms 106 and pivots 108 and 110, any other controllably adjustable mechanical mounting of panels 102 may be used to allow controlled relative movements of the panels.

Controller 112 may include conventional electrical control circuitry (e.g., microprocessor controlled) to achieve controlled accurate adjustment of electromechanical actuators. For example, controller 112 may optionally control movement of panels 102 responsive to movements of the vehicle on which antenna 100 is mounted, such that a common beam pointing direction of panels 102 is constantly directed toward satellite 102 (e.g., using suitable beam tracking feedback control circuits driven by received RF signal strength), while forming an apparently substantially continuous antenna plane when viewed from the satellite, i.e., from beam pointing direction 116. Thus, for low satellites requiring a close to horizontal beam direction 116, panels 102 are distanced from each other by a relatively large distance (indicated by arrow 124), while for high orbit satellites, the horizontal distance between panels 102 is very small, is zero or is even negative, as discussed below.

Controller 112 may include suitable controls for substantially any type of driving actuator, such as a pneumatic actuator, electrical actuator or a linear or rotary motor with suitable mechanical transmission linkage. The driving actuator may be linear or non-linear. As will be appreciated, the mechanical actuators are mechanically linked to the antenna apparatus so as to control pivoting and/or other motions as required.

Panels 102 optionally all have the same electronic tilt angle $\alpha$ and are controlled by controller 112 to have the same elevation angle $\phi$, in order to minimize side lobes and/or other signal degradation effects.

The tilt angle $\alpha$ may be "built in" (e.g., a fixed value) and may be optionally selected according to the range of possible beam directions (e.g., to satellites with which antenna 100 is to be used to communicate). In an exemplary embodiment, tilt angle $\alpha$ is selected in the middle, or close to the middle, of the range of desired possible beam direction angles from antenna 100 to the satellite. For example, for a desired range of 10°-80°, a built-in panel tilt of a $\alpha$=45° may be used. Thus, perpendicular line 118 need only have a range of physical movement between 55°-135°. For this example, panels of length L, rather than requiring a maximum height above base 104 of H=L*cos(10°)=0.98L, a maximal height of only H'=L*cos(45°)=0.707L is required.

Alternatively, instead of defining the inherent or built-in fixed tilt $\alpha$ according to the range of possible beam directions, the tilt angle $\alpha$ may be selected according to probabilities of the angles, in a manner which reduces or minimizes height of panels 102 above base 104 a large portion of time.

In some embodiments, for simplicity, the tilt angle $\alpha$ is selected such that a maximum movement angle for perpendicular line 118 does not exceed 90° (i.e., a vertical direction as measured from the horizon), at which 90° position the distance 124 between panels 102 is zero. Alternatively, as is described with reference to FIG. 2, the range of elevational angles of perpendicular line 118 may be allowed to exceed 90°.

Figure 2:
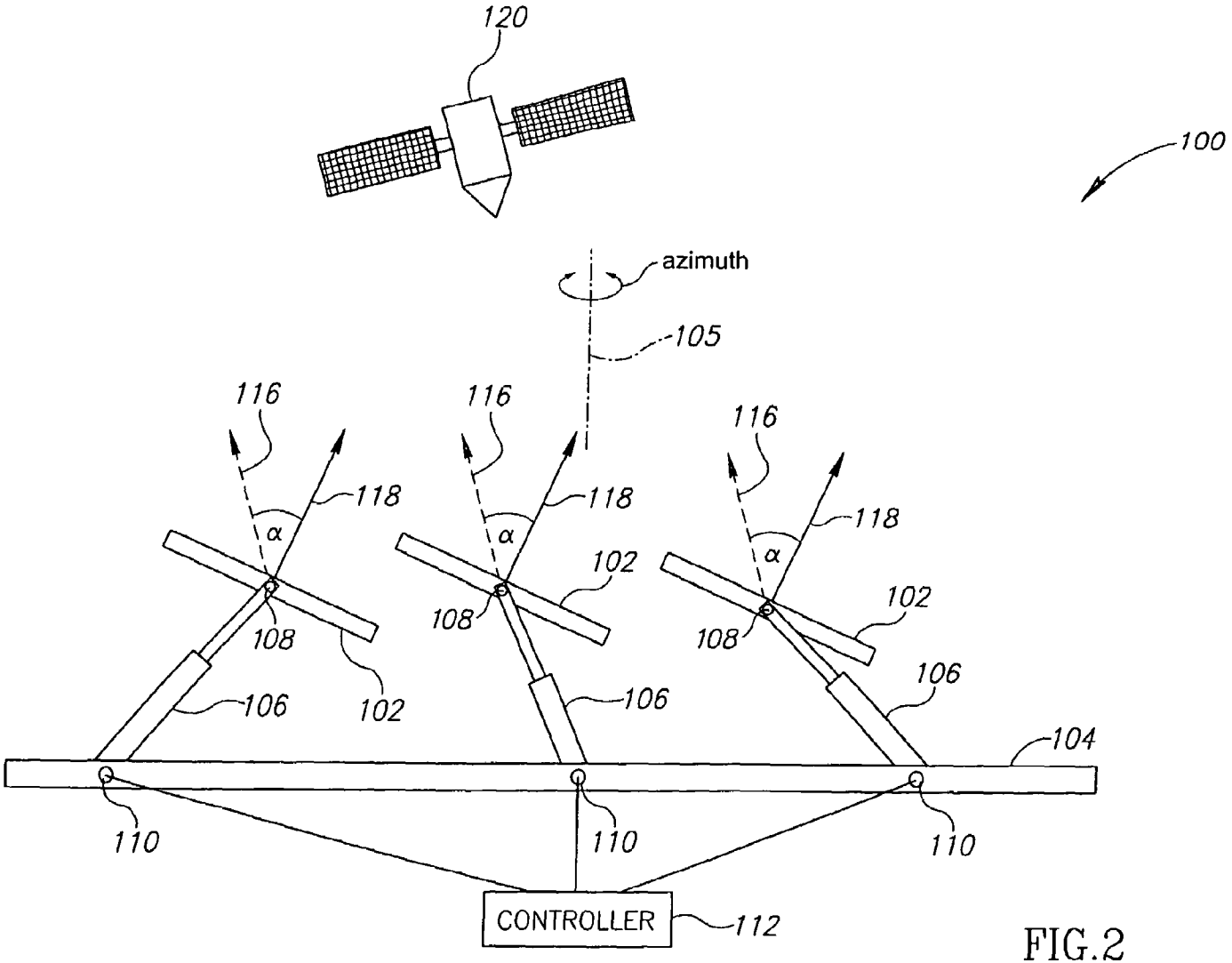
FIG. 2 is a schematic side view of the antenna of FIG. 1, with a pointing angle tilted away from 90° with respect to an antenna base structure.

FIG. 2 is a schematic side view of an antenna 100 where a panel perpendicular 118 has a maximum angle of elevation greater than 90°. When antenna 100 is directed at satellite 120 with a close to vertical tilted beam pointing direction 116, perpendicular 118 is in a different quadrant than tilted beam direction 116. In order that panels 102 will form an apparently continuous surface as viewed from beam pointing direction 116, panels 102 may need to overlap in a vertical plane (e.g., perpendicular to a horizontal base 104), such that the horizontal distance between the edges of adjacent panels 102 can be considered "negative".

In some embodiments, at substantially any pointing angle, panels 102 are positioned at the same height above base 104 (e.g., their lowest points are at a same height above base 104). Alternatively, in at least some angles of tilted beam direction 116, different panels 102 may be at different heights above base 104. In some embodiments, in accordance with this alternative, when panels 102 are in a negative displacement state, i.e., the panels partially overlap in a vertical plane, the panels are at different heights above base 104, to allow overlap. In other embodiments, at low angles of beam pointing direction 116, panels 102 may be at different heights to reduce horizontal distance 124 (FIG. 1) between the panels 102 and hence the total area (volume) occupied by antenna 100. In still other embodiments, panels 102 are at different heights at substantially all pointing angles, for example in order to allow positioning of controller 112 beneath one or more panels.

In some embodiments, antenna 100 has a wide range of possible beam pointing angles, covering at least 50°, at least 65° or even at least 75°. Preferably, controller 112 adjusts panel orientations and locations, such that when viewed from the beam pointing direction, the panels appear to form a continuous surface without overlap or gaps, over the entire range of beam pointing directions of the antenna. Alternatively, at some beam pointing angles, panels may be allowed to partially overlap. In some embodiments, a maximum horizontal distance between adjacent panels is defined by structural limitations. At those angles where preventing overlap (when viewed from the beam direction) would require a larger distance than such maximum, overlap is allowed. Preferably, overlap is allowed in less than 20% of the range of beam direction angles, or even in less than 10% or less than 5% of the range of beam pointing direction angles. Alternatively or additionally, the maximum horizontal distance between panels is selected such that more than 5% or even 10% of the range of beam direction angles involves partial panel overlap.

Optionally, the range of possible beam pointing directions for antenna 100 is predetermined at the time of production. Alternatively, the range of beam directions may be configurable. The range of beam directions is optionally selected according to the position of a remote transmitter/receiver with which antenna 100 is expected to communicate, the width of the antenna principle beam and/or the surface area of the antenna or other design parameters as will be appreciated.

Figure 3:
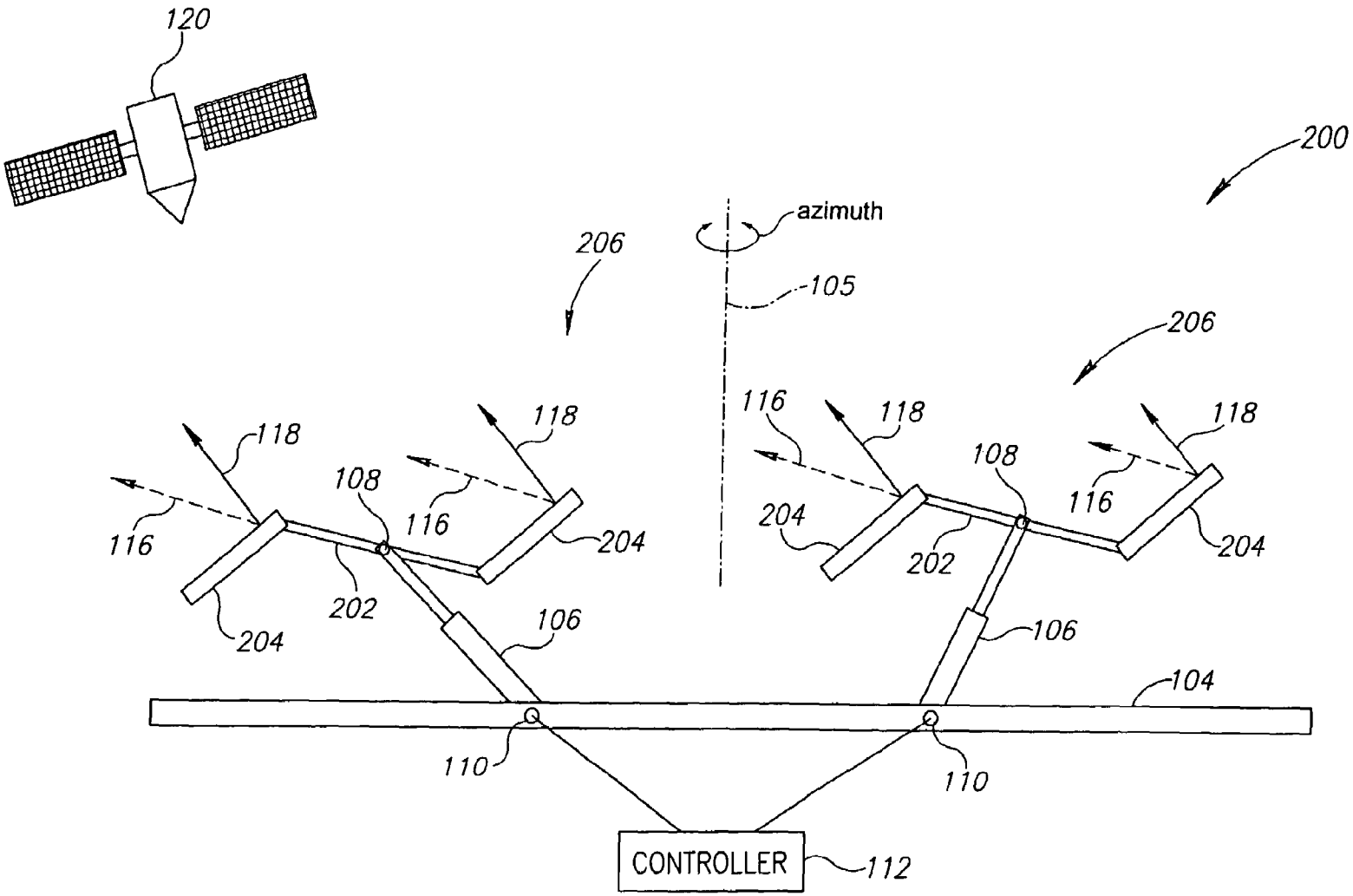
FIG. 3 is a schematic illustration of an antenna with antenna sub-assemblies, in accordance with another exemplary embodiment.

FIG. 3 is a schematic illustration of an antenna 200, in accordance with another exemplary embodiment. Antenna 200 includes a plurality of sub-units 206 (two in FIG. 3), each of which is formed of a plurality (e.g., 2) of panels 204 held together in a fixed orientation, for example by one or more rods 202. As in antenna 100, each sub-unit 206 is mounted on a controllable arm 106 (e.g., see controllable rotary joints 108, 110) and is controllably moved by controller 112 relative to the other sub-units 206 and base 104. The use of panels 204 fixed relative to each other allows achieving some low profile benefits associated with a large number of panels, while avoiding the need to separately control movements of each of a large number of panels.

In some embodiments, panels 204 do not need to have a built-in tilt (e.g., because height reduction due to the use of a large number of panels 204 may be considered sufficient). In other embodiments, however, as illustrated by antenna 200, panels 204 of sub-units 206 have built-in tilt to beam pointing angle 116, to reduce antenna profile as much as possible. Relative orientation of panels 204 in a single sub-unit 206 is optionally selected such that, when viewed from beam pointing direction 116, the panels 204 form an apparently continuous surface. That is, controller 112 optionally controls pointing movements (e.g., including electrical tilt 116) of sub-units 206 relative to each other such that all panels 204 appear to be on a continuous surface as viewed from beam direction 116.

While only two panels 204 are shown in FIG. 3 as being part of each sub-unit 206, in some embodiments, one or more of sub-units 206 may include more than two panels 204 or even more than three or more than four panels 204. In some embodiments, all sub-units 206 in a single composite antenna structure have the same number of panels 204. Alternatively, different sub-units 206 may have different numbers of panels 204.

Figure 4:
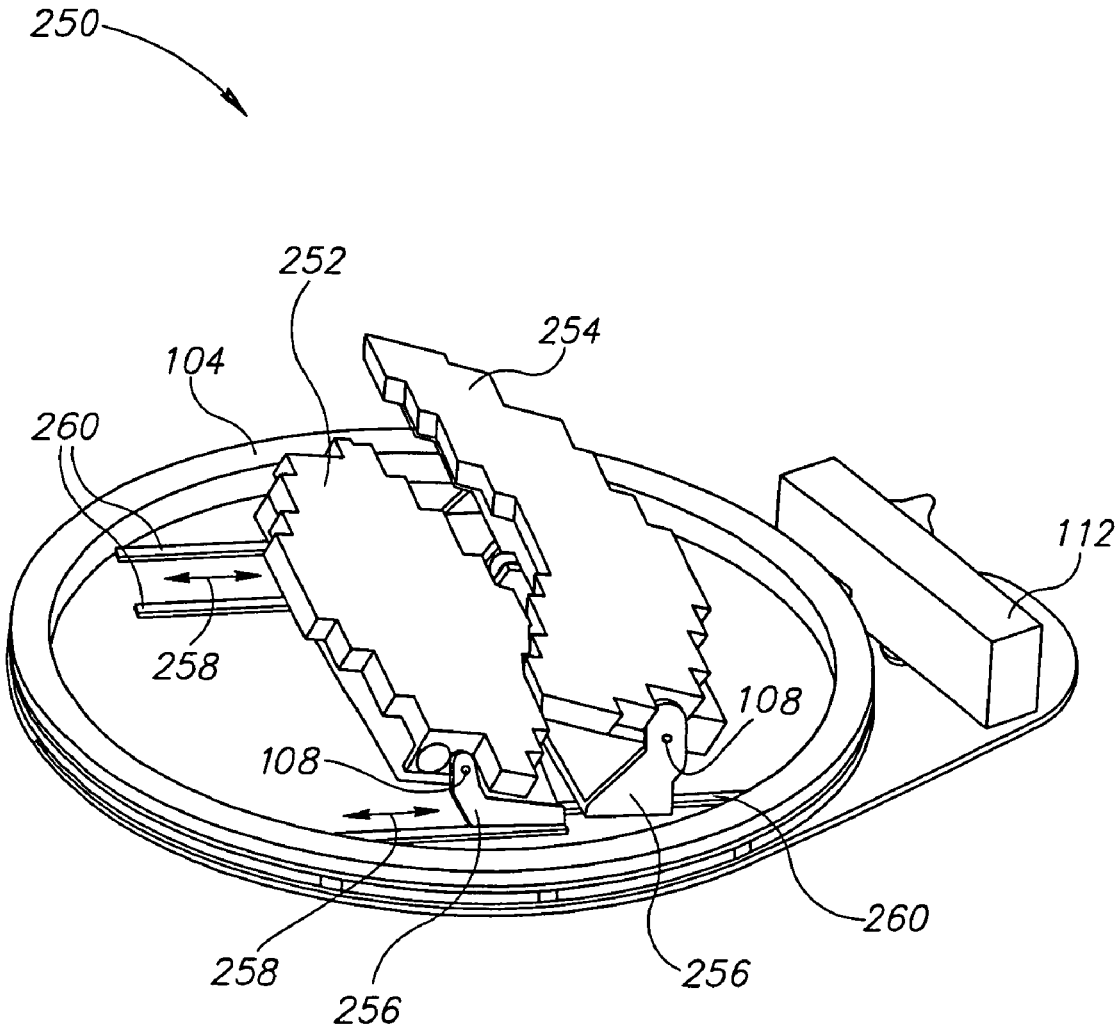
FIG. 4 is a schematic perspective view of an antenna, in accordance with another exemplary embodiment.

Controller 112 is optionally located beside base 104, as shown in FIG. 4. Alternatively, controller 112 may be located on base 104, for example beneath one of panels 252 and 254.

In some embodiments, all panels 204 or 102 may be of the same size and shape. Alternatively, for example, to help reduce side lobes, different ones of the panels may have different shapes, for example as described with reference to FIG. 4.

FIG. 4 is a schematic view of an antenna 250, in accordance with an exemplary embodiment. Antenna 250 also includes rotatable base 104—now carrying two panels 252 and 254 rotatably mounted at 108 on racks 256. Racks 256 are slidably mounted (e.g., see arrows 258) on rails 260 fixed to base 204. Controller 112 controls the elevational angles and horizontal locations of panels 252 and 254 such that the panels substantially constantly appear to form a continuous surface as viewed from the beam pointing direction (e.g., as viewed from a tracked earth orbiting satellite transceivers).

Figure 5:
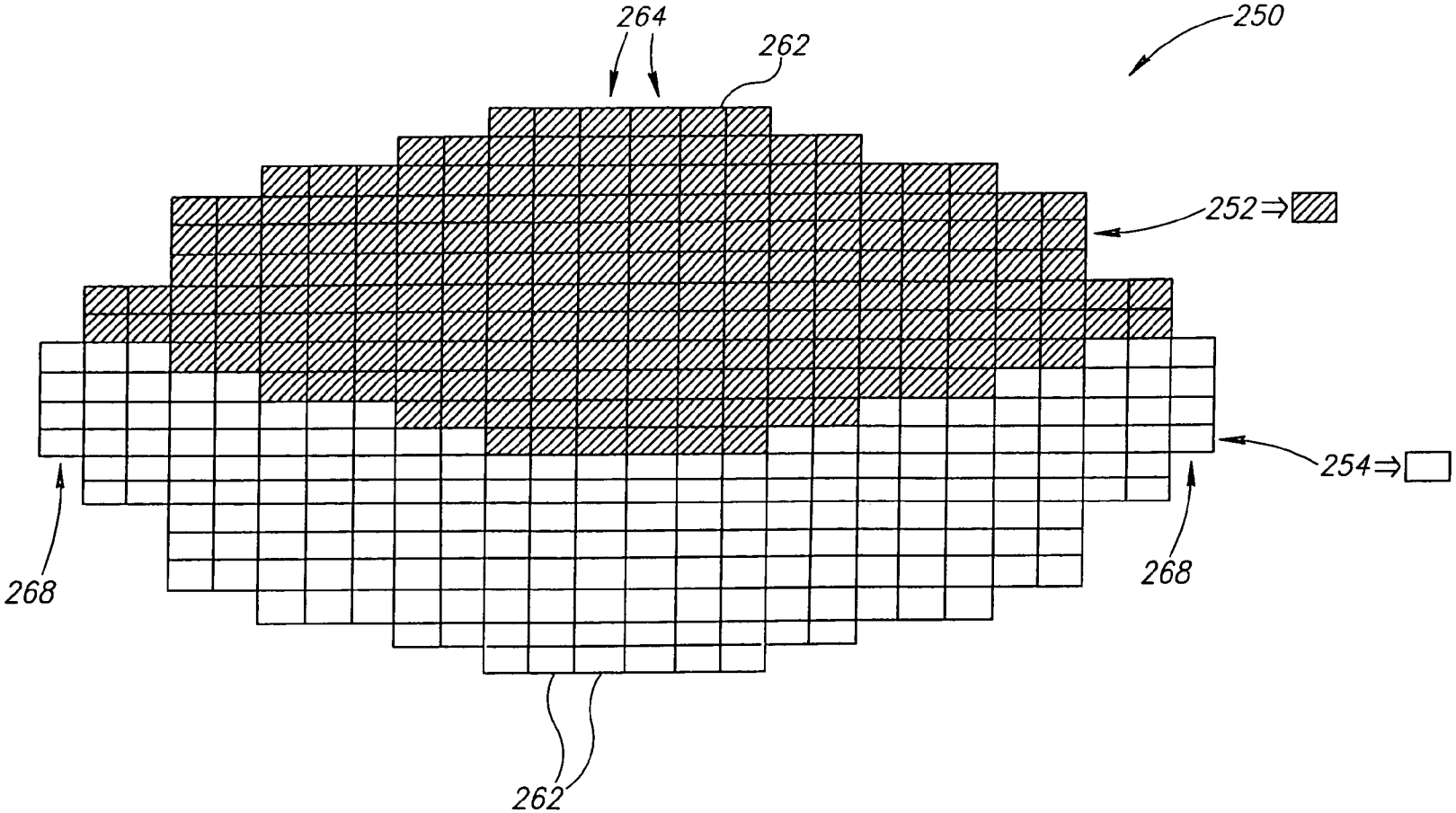
FIG. 5 is a schematic illustration of the antenna of FIG. 4, as from the beam pointing direction of the antenna array.

FIG. 5 is a schematic illustration of antenna 250 as viewed from the beam pointing direction, in accordance with an exemplary embodiment. As mentioned above, antenna 250 comprises panels 252 and 254 which appear to form a continuous surface when viewed from the beam pointing direction (as in FIG. 5). Each of panels 252 and 254 is formed of a plurality of active antenna radiator elements 262 (depicted as elemental rectangular blocks in FIG. 5).

Active elements 262 may include cavity backed dual polarization aperture transceivers radiator elements (e.g., as described in copending U.S. patent application Ser. No. 11/440,054 which is hereby incorporated by reference). Alternatively, any other types of elements may be used, such as microstrip patch antenna radiators and the like (as will be understood by those in the art).

In an exemplary embodiment, active elements 262 are of a size of about 12×14 millimeters, although other sizes may be used as long as grating lobes are avoided. Antenna 250 operationally includes at least 300 elements 262 or even at least 400 such elements. The number of elements 262 in antenna 250 can be selected to achieve a required antenna gain factor.

Antenna 250 has an overall oval shape, to help improve side-lobes (e.g., because a tapered array radiation aperture is thereby defined). Preferably, at least one row of antenna 250 has more elements than a column with the most elements. Elements 262 may be rectangular, with their larger dimension parallel to a major axis (e.g., along the rows) of the antenna. In some embodiments, most columns of antenna 250 have elements from both panels 252 and 254, while most rows of antenna 250 have elements from only a single panel 252 or 254. In some embodiments, less than 40%, or even less than 25% or the rows of antenna 250 include elements in more than one panel.

Central columns 264 (six of which are schematically depicted in FIG. 5) may have a maximum number of columnar elements 262 in all of antenna 250. The number of elements in columns in some embodiments does not increase from the column(s) with the most elements 262 as one moves toward the outer lateral edge columns (e.g., with monotonically decreasing numbers of elements), such that the edge columns 268 have the fewest elements 262. In some embodiments, one panel, namely panel 252 (shown with hashed elements in FIG. 5), has an oval shape by itself. Panel 254 (shown with open rectangular elements in FIG. 5) then preferably has a mating banana or crescent-like shape which, with panel 252, forms a larger oval. Each of panels 252 and 254 may have a monotonic layout of elements as described above, such that the number of elements in each column is non-increasing from a centrally positioned column with the most elements as one moves outwardly. A column with the most elements may be within a central third of the panel (e.g., one or more central columns).

In some embodiments, panels 252 and 254 have a monotonically non-increasing layout of "horizontal" rows of elements, such that from a row having the most elements, the number of elements in the rows decreases monotonically as one moves toward each top and bottom side (as depicted in FIG. 5). The row with the most elements may be the central row. Alternatively, as in banana-shaped panel 254, a row with the most elements may be located slightly off from the center. Preferably, a row with the most elements may be within a central third of the rows (e.g., the seventh and eighth rows out of twelve).

Antenna panels 252 and 254 may have the same number of elements organized in the same number of rows. It is noted, however, that in some embodiments, the number of columns in panels 252 and 254 can be different, (e.g., banana-shaped panel 254 may have more columns than oval panel 252).

In some embodiments, the border between panels 252 and 254 is an approximately curved line (albeit pixelated due to the non-zero size of elements 262). Panels 252 and/or 254 may be, for example, oval, circular, and/or in other shapes, including a pseudo random shape to achieve desired side lobe or other antenna characteristics.

Antenna 250 is preferably symmetric around at least one axis. In some embodiments, antenna 250 may be symmetric around both of orthogonal axes (e.g., a horizontal axis and a vertical axis). Preferably, an axis of symmetry of antenna 250 does not coincide with the border between panels 252 and 254.

Figure 6:
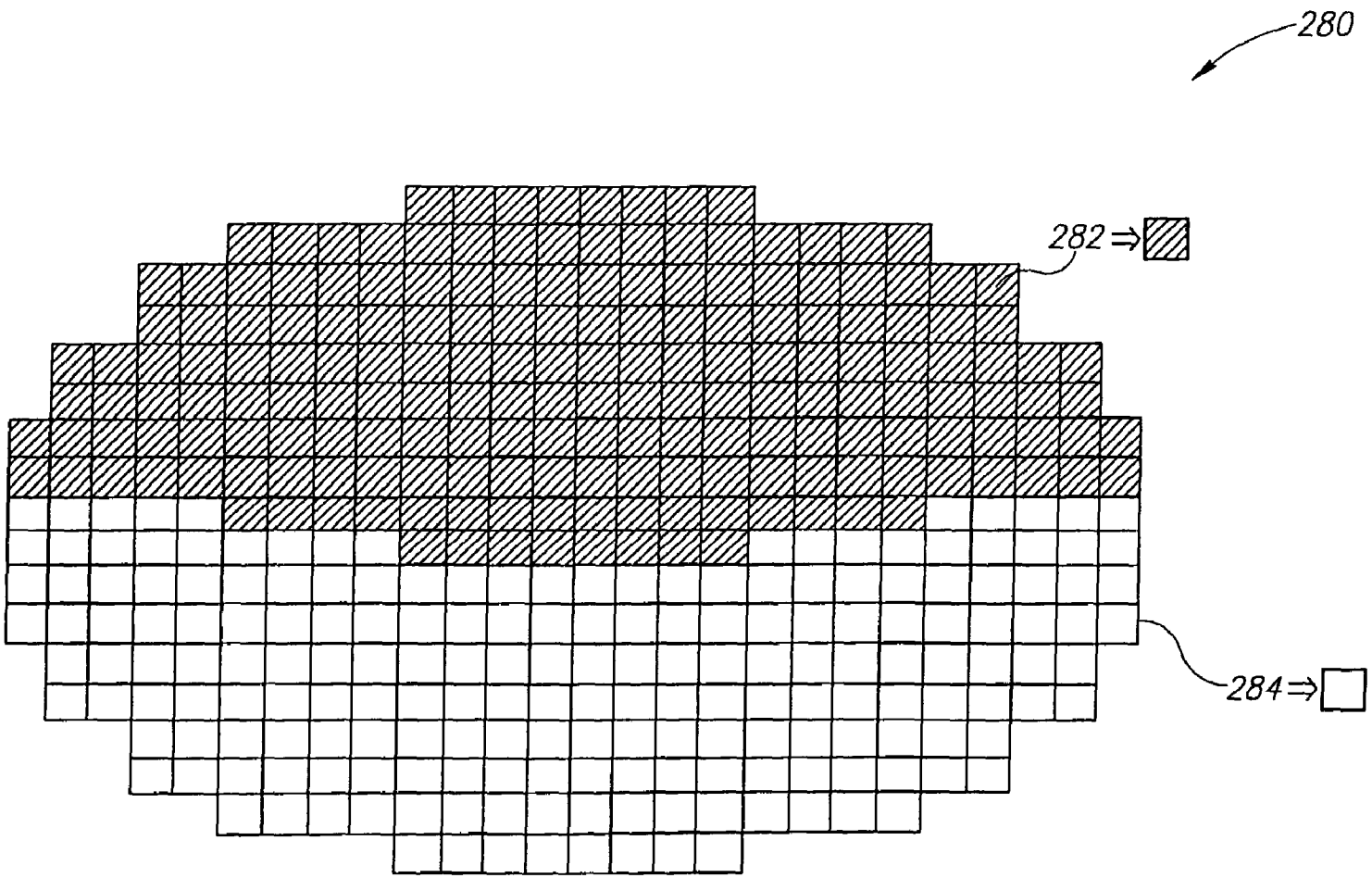
FIG. 6 is a schematic illustration of another antenna as viewed from the beam direction of the antenna, in accordance with another exemplary embodiment.

FIG. 6 is a schematic illustration of an antenna 280 as viewed from the beam pointing direction of the antenna, in accordance with another exemplary embodiment. Antenna 280 includes a relatively oval panel 282 (shown in FIG. 6 with hatched square elements) and a banana-shaped panel 284 (shown in FIG. 6 without hatching), with a different layout from antenna 250. In antenna 280, the rows having the most elements are closer to the common edge of panels 282 and 284, optionally within 40% or even 30% of from the common edge. The number of rows having elements in both panels is less than 20% of the rows, and even less than 15% of the rows.

Figure 7:
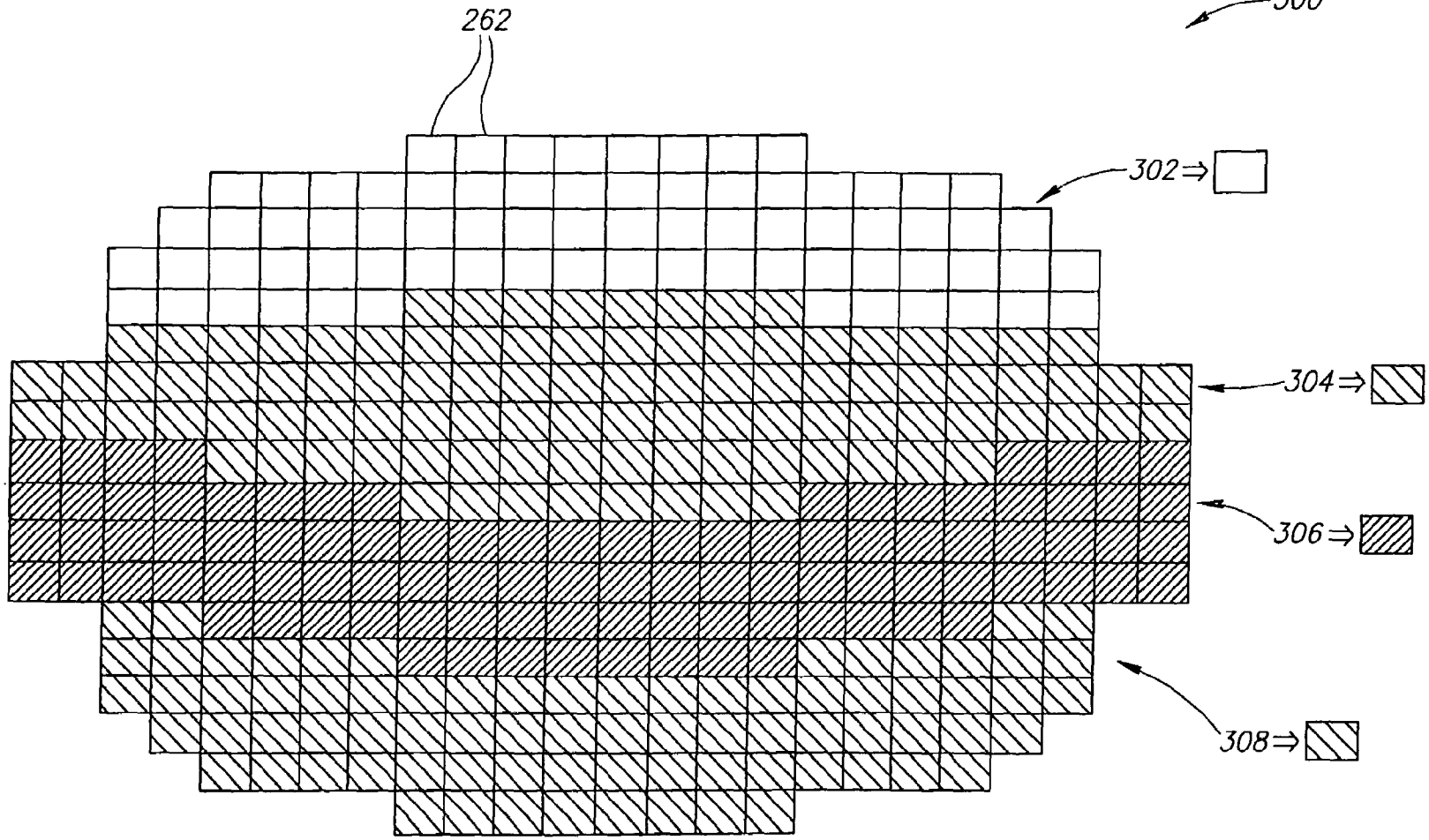
FIG. 7 is a schematic illustration of an antenna as viewed from the beam pointing direction of the antenna, in accordance with still another exemplary embodiment.

FIG. 7 is a schematic illustration of an antenna 300 as viewed from the beam pointing direction of the antenna, in accordance with another exemplary embodiment. Antenna 300 includes four panels 302, 304, 306 and 308 (each shown with square elements distinguished from those of an adjacent panel by hatch marks in FIG. 7). The panels may all be controlled in their respective positions separately, or may be combined into commonly controlled pairs of panels as discussed above with reference to FIG. 3.

Panel 304 is relatively oval in shape, while the other panels are suitably crescent-shaped to provide complete panel 304 as a larger oval shape. In some embodiments, all panels have the same number of rows. Alternatively, one or more of the panels may have a different number of rows (e.g., panel 302).

In some embodiments, all panels have the same number of elements. Alternatively, each of the panels may have a different number of radiator elements 262. In some embodiments, each pair of panels 302, 304 and 306, 308 are fixed together (i.e., with respect to each other).

Figure 8:
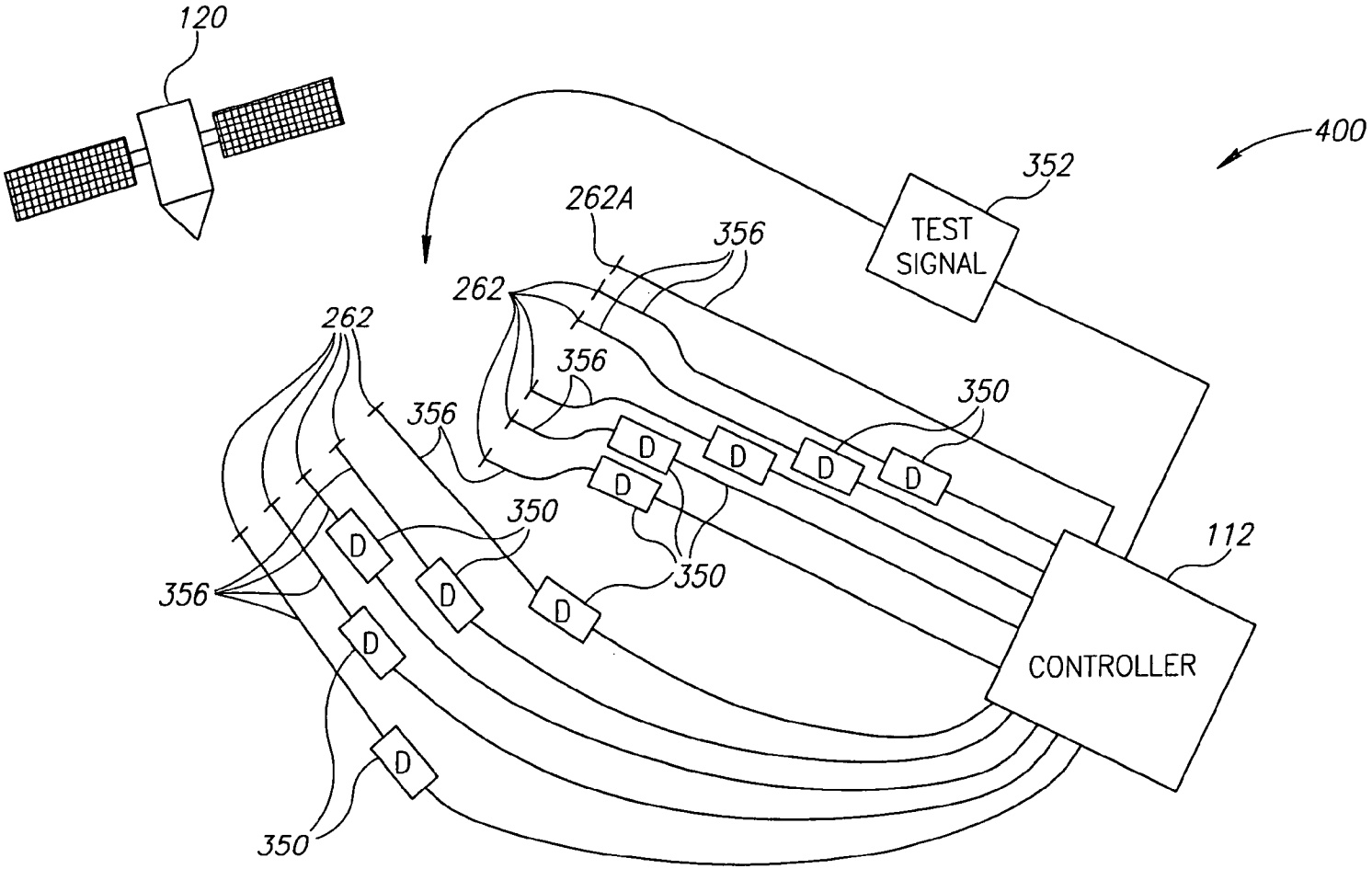
FIG. 8 is a schematic illustration of signal paths between antenna elements and a controller of the antenna, in accordance with an exemplary embodiment.

FIG. 8 is a schematic illustration of transmission line signal paths between antenna RF radiator elements 262 and controller 112 (or a directly connected receiver or transmitter) in an antenna system 400, in accordance with an exemplary embodiment. As will be appreciated, a typical feed transmission line structure may include a corporate-organized microstrip transmission line structure leading from a common feed point to each individual radiator element. Each antenna radiator element 262 is optionally connected to controller 112 (or to a transceivers) through a delay unit 350. Alternatively, one or more of elements 262 are base elements 262A, which are defined to have zero relative delay and therefore do not have a delay unit 350 along their connection with controller 112.

Delay units 350 optionally add (to at least some of the signal paths) respective delays, which compensate for different distances between a given radiator element 262 and satellite 120. It will be understood that suitable relative phasing between elements 262 and/or 262A must also be provided to achieve desired phased array operation (e.g., tilt direction 116). Such relative phase control may be included in delay units 350 or provided separately as will be appreciated. After adding the delays provided by delay units 350, the signal paths between satellite 120 and control 112 through substantially all of elements 262 may have the desired propagation time (e.g., equal). Optionally, at least one of delay units 350 adds a delay of at least three, at least five or even at least eight wavelength propagation time periods of the transmitted/received signals. Correcting for the entire multi-wavelength delay (e.g., not only for relative partial wavelength or phase differences) can achieve a more accurate correction, which is worth the slightly longer overall delay time.

It is noted that in those embodiments in which antenna panels are to have a built-in electrical tilt angle, the delay added by different delay units is optionally selected in a manner which includes relative phase controls to induce the desired electronic tilt. Those in the art will appreciate that conventional phased array beam steering effects can be included with the delay compensation—and that he delays can be dynamically controlled to change the tilt angle and/or delay compensation as the panels are physically moved with respect to base 104 and/or satellite 120.

In some embodiments, antenna 400 may include a test signal generator 352, which can be used in calibrating delay units 350. Optionally, when calibration is required, generator 352 generates a known test signal which is coupled to antenna elements 262, 262A. Controller 112 measures reception characteristics (e.g., relative propagation delays along each elemental channel) of the test signal and accordingly adjusts delay times of delay units 350 to achieve the desired antenna characteristic(s). For example, the test signal may be provided to transmission lines 356 that connect elements 262 to delay units 350.

In some embodiments, the test signal is injected when antenna 400 is not used for signal reception and/or transmission. Optionally, calibration is performed at set-up and/or as part of long term maintenance procedures. Alternatively or additionally, payload data transmission and/or reception can be stopped periodically for a short period (preferably imperceptible to an average user), in order to perform calibration. Alternatively or additionally, the test signal can use one or more carrier frequencies not used for data transmissions (i.e., it can be frequency multiplexed with ongoing data traffic on other frequencies). In some embodiments, the calibration is performed at least once a day or even once an hour. Alternatively, the calibration is performed at a high rate, at least once every minute or even once every second.

All above described antenna configurations may be used for both half-duplex (e.g., only reception or only transmission) and full-duplex antennas (i.e., which service concurrent RF reception and transmission). The antennas described above may be used for substantially any type of communications, such as reception from a direct broadcast television satellite (DBS) located in a fixed orbital position (geostationary) satellite and/or for communication with a millimeter wave (MMW) geosynchronous satellite. Alternatively or additionally, the above described antennas are used for ground-based communications. The antennas may be used, for example, in multi-channel multi-point distribution systems (MMDS), in local multi-point distribution systems (LMDS), cellular phone systems and/or other wireless communication systems where low profile antennas are required or preferred. In some embodiments, the antennas are used in low energy communication systems.

In an exemplary embodiment, an antenna implementing one or more of the above described features operates in a "C-band" system, using carrier frequencies between about 3.7-4.2 GHz. Alternatively or additionally, the above described antennas operate in the millimeter wave range, at wavelengths shorter than the MMW range, such as sub-millimeter waves and/or terra-beam waves, and/or at wavelengths longer than the MMW range, such as microwave wavelengths. In an exemplary embodiment, the above described antennas operate at about 24 mm wavelength range, i.e., 10-15 GHz.

The above described antennas may be used for substantially all types of signals, including audio, video, data and multimedia.

The following table provides an illustration (based on simulated antenna operation using an oval multi-panel antenna as in FIGS. 5-7) of substantial improvements in sidelobes (and even minor improvements in gain) that can be achieved by adding time delay compensation at each of various antenna elevation pointing angles. The last three lines of this table represent low elevational angles where there was simulated "overlap" of panels in the vertical direction.

| Before correction | | | | After correction | | | |
|---|---|---|---|---|---|---|---|
| Angle Antenna Pointing degrees | Gain dB | Squint degrees | Side-lobe Level, dB | Add. time delay $\Delta d_1$, ps | Gain dB | Squint degrees | Sidelobe Level, dB |
| 90 | 37.9 | 0 | −20 | | | | |
| 80 | 37.76 | 0 | −17.8 | 1.5 | 37.79 | 0 | −19 |
| 70 | 37.74 | 0.5 | −15 | 3.5 | 37.79 | 0 | −17.8 |
| 60 | 37.7 | 0.5 | −14 | 5.5 | 37.75 | 0 | −17.5 |
| 50 | 37.52 | 0.5 | −12.5 | 7 | 37.7 | 0 | −17 |
| 40 | 37.5 | −1 | −11 | 11 | 37.7 | 0 | −16 |
| 30 | 37.23 | −1.5 | −9 | 16 | 37.7 | 0 | −16.5 |
| 20 | 36.44 | −2 | −5 | 24 | 37.78 | 0 | −16.2 |
| 15 | 34 | −2.5 | −1 | 32 | 36.6 | 0 | −13.3 |

Figure 9:
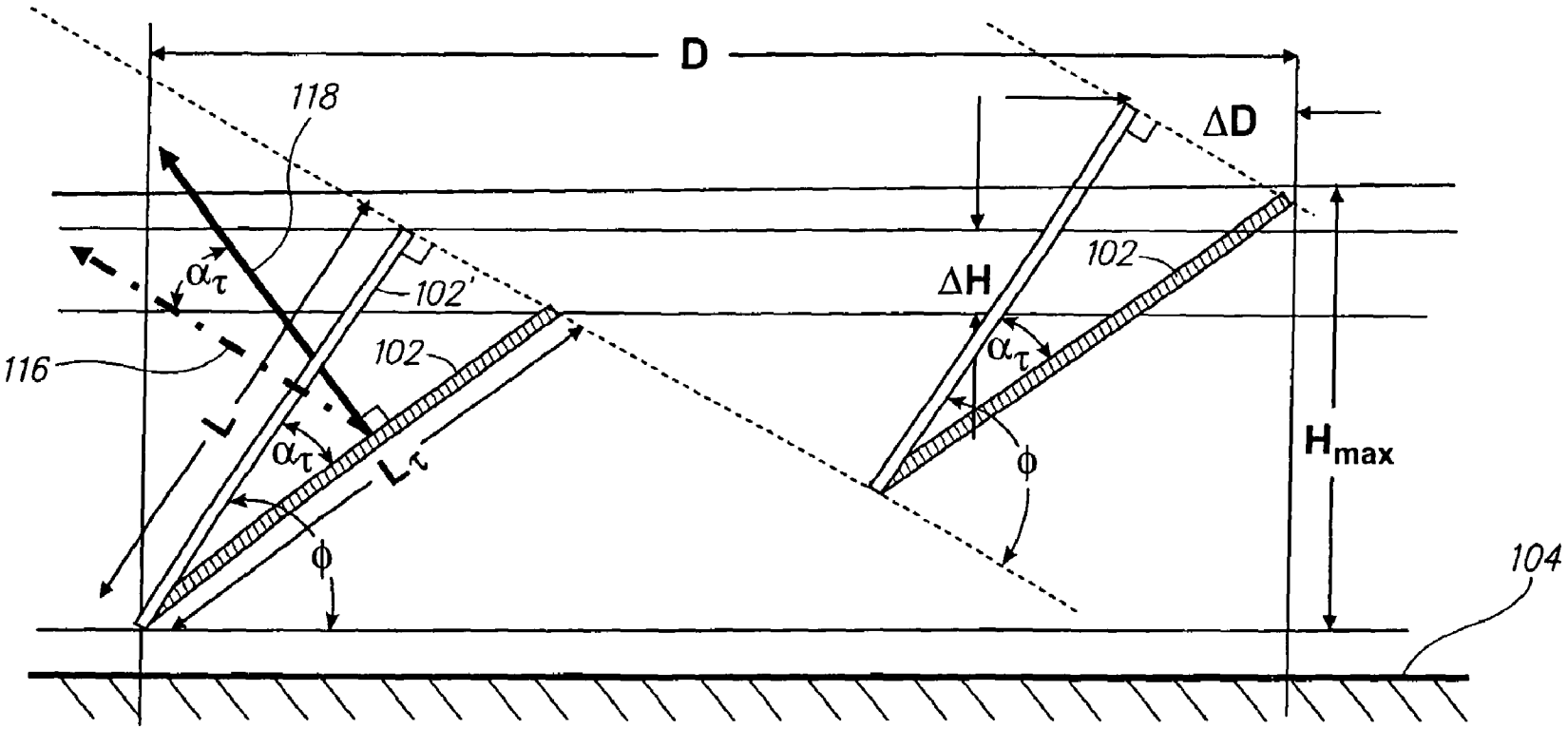
FIGS. 9-11 are schematic illustrations illustrating the splitting of the antenna into plural panels, controlling the plural panels in a positive displement mode and in a negative displacement mode respectively.

FIG. 9 schematically depicts an embodiment wherein sub-array panels 102 are depicted at different ($\Delta$ H) heights above the mounting base 104. As will be appreciated, only two panels have been depicted (and controlled movement mechanisms not shown) to simplify the depiction and to better teach salient movement parameters. A maximum height $H_{max}$ permitted by the physical mechanical constraints of movement is also depicted. An "effective" pseudo panel position is also depicted as a pseudo panel 102' constructed at a right angle to the beam pointing direction 116. This is, in effect, the projection of panel 102 when viewed from the beam pointing angle direction. A similarly constrained (i.e., by finite dimensions and parameters of a particular physical embodiment) maximum horizontal dimension (e.g., D) will also be present as those in the art will appreciate. The elevation angle $\phi$ for the beam pointing direction 116 is also depicted.

Figure 10:
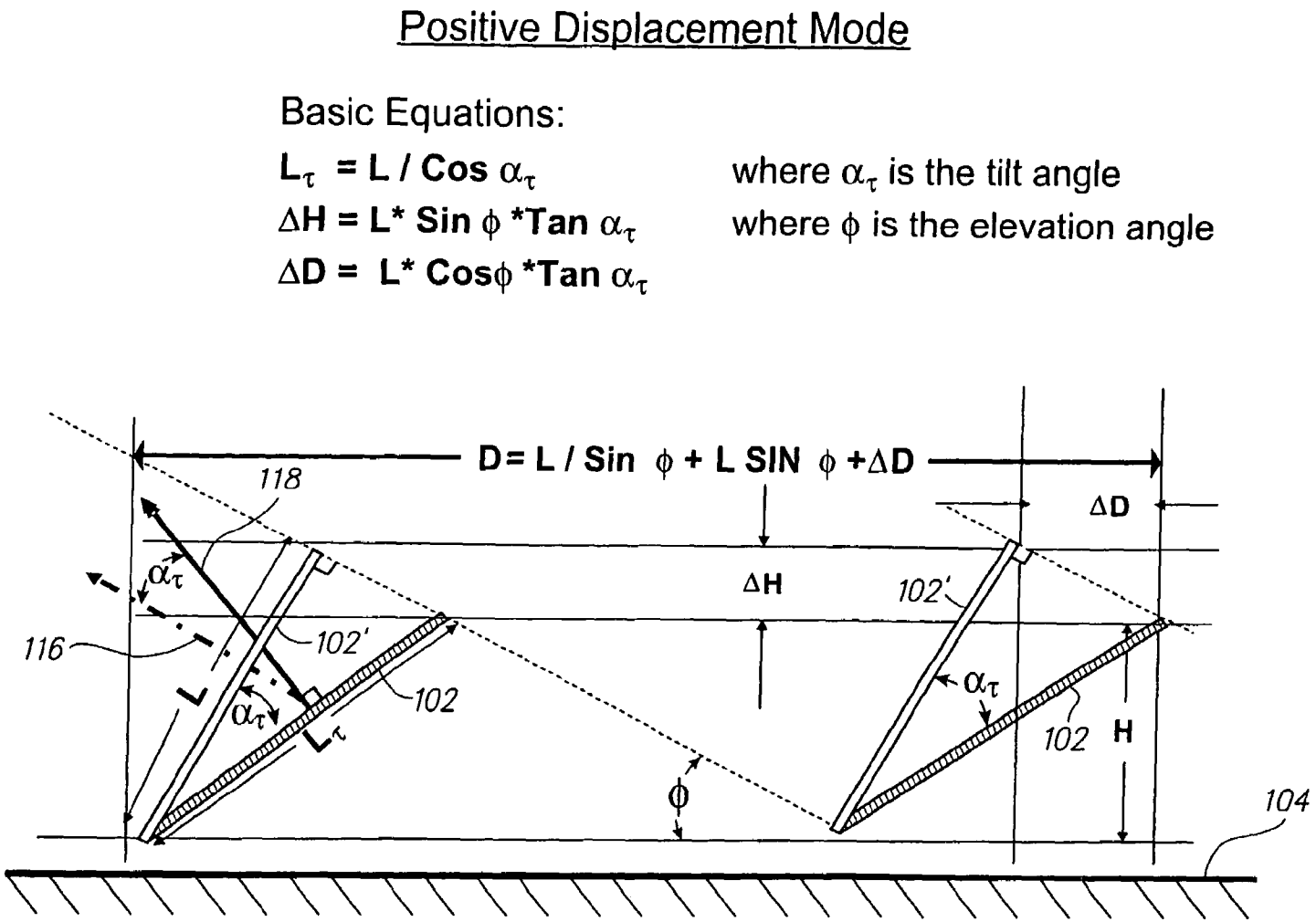
Figure 11:
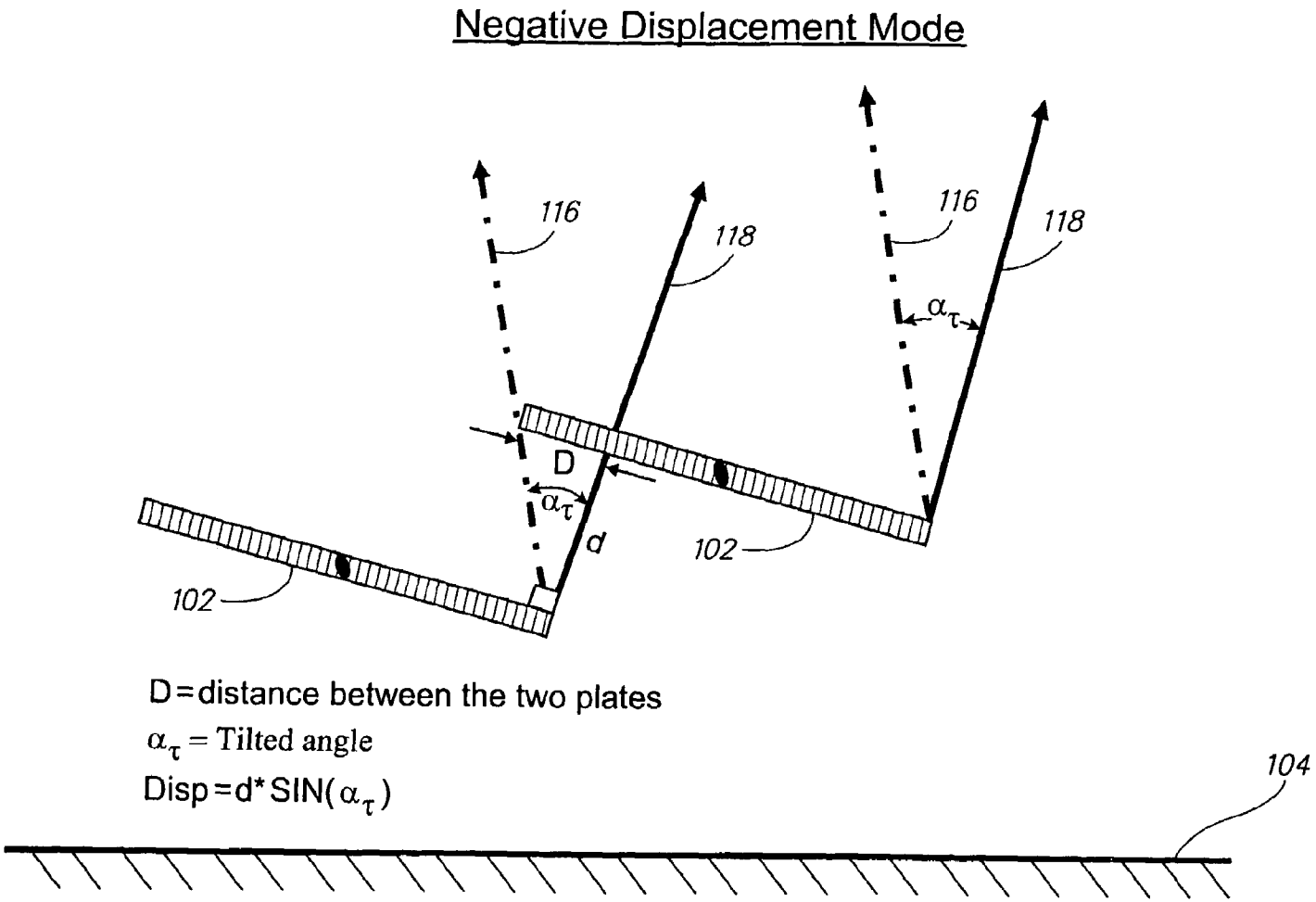

Operation of the FIG. 9 embodiment during a "positive" displacement mode is depicted in FIG. 10. Here the equations for controlled motion within the system constraints for given controllable parameters are shown. Similarly, operation of the FIG. 9 embodiment during a "negative" displacement mode is depicted in FIG. 11. Here the equations for controlled motion within the system constraints for given controllable parameters are shown.

The above exemplary embodiments have been described using non-limiting detailed descriptions that are provided by way of example and are not intended to limit the scope of the appended claims. It should be understood that features and/or steps described with respect to one embodiment may be used with other embodiments and that not all embodiments have all of the features and/or steps shown in a particular figure or described with respect to one of the embodiments. Variations of embodiments described will occur to persons skilled in the art. It will be appreciated that the above described description of methods and apparatus is to be interpreted as including apparatus for carrying out the methods and methods of using the apparatus.

It is noted that some of the above described embodiments describe the best mode presently contemplated by the inventors and therefore include structure, acts or details of structures and acts that may not be essential to the invention and which are therefore only described as examples. Structure and acts describe herein are replaceable by equivalents which perform the same function, even if structure or acts are different, as known in the art.

What is claimed is:

1. A multi panel antenna, comprising:

a plurality of panels, each including a plurality of arrayed antenna radiator elements;

a mechanical mount structure carrying the panels in a manner which allows movement of at least two of the panels relative to each other;

an RF signal transmitter and/or receiver adapted to respectively transmit and/or receive RF signals through the radiator elements of the panels;

RF transmission lines connecting the RF signal transmifter and/or receiver to the radiator elements in a manner which is capable of inducing electrical tilt in a pointing angle of a radiation pattern beam of one or more of the panels; and a controller adapted to mechanically rotate the panels over a range of radiation pattern beam pointing directions, while also moving the panel centers relative to each other such that when viewed from the beam pointing direction of the panels they appear to present a continuous surface without overlap or gaps over at least some range of beam pointing directions, wherein the controller is adapted to mechanically move the panels over a range including an angle in which the beam pointing direction of the panels and a line perpendicular to the panels are in separate quadrants of space when divided by horizontal and vertical lines intersecting at an axis of panel rotation.

2. The multi panel antenna as in claim 1 wherein said mechanical mount structure comprises a plurality of assemblies such that at least one of said assemblies is configured to pivot at its base.

3. The multi panel antenna as in claim 1 wherein said controller mechanically rotates the panels over a range of radiation pattern beam pointing directions while also moving the panel centers relative to each other rotates said panels and moves the centers of said panels relative to each other as part of a single complex movement.

4. The multi panel antenna as in claim 1 wherein said RF transmission lines induce an electrical tilt in a pointing angle of a radiation pattern beam of one or more of the panels such that said electrical tilt is fixed.

5. The multi panel antenna as in claim 1 wherein said RF transmission lines induce an electrical tilt in a pointing angle of a radiation pattern beam of one or more of the panels such that said electrical tilt is adjustable.

6. The multi panel antenna as in claim 1 wherein said electronic tilt is at least a 45 degree angle from a perpendicular to said panels, and the range of possible beam pointing angles covers at least 75 degrees.

7. The multi panel antenna as in claim 1 wherein said panels when viewed from the beam pointing direction appear to present a continuous surface without overlap or gaps over at least some range of beam pointing directions; and wherein said panels when simultaneously viewed from an angle perpendicular to the panels appear to present a discontinuous surface with overlaps or gaps.

8. A multi panel antenna, comprising:

a plurality of at least four panels, each including a plurality of arrayed antenna radiator elements;

at least two assemblies of the panels, each assembly including at least two panels that are displaced from each other and also fixed in position with respect to each other so that they do not move relative to each other but are movable together as a unit with respect to at least one other panel;

a mechanical mount structure carrying the panel assemblies in a manner which allows movement of at least two of the panel assemblies relative to each other, said movement of at least two of the panel assemblies comprising lateral movement wherein the centers of said assemblies move relative to each other;

an RF signal transmitter and/or receiver adapted to respectively transmit and/or receive RF signals through the radiator elements of the panels;

RF transmission lines connecting the RF signal transmitter and/or receiver to the radiator elements; and a controller adapted to mechanically move the panel assemblies over a range of radiation pattern beam pointing directions.

9. A multi panel antenna as in claim 8 wherein said controller is adapted to move the panel assemblies relative to each other such that when viewed from the beam pointing direction of the panels they appear to present a continuous surface without overlap or gaps over a multiplicity of angles in the range of possible beam pointing angles.

10. A multi panel antenna, comprising:

a plurality of panels, each including a plurality of arrayed antenna radiator elements;

a mechanical mount structure carrying the panels in a manner which allows movement of at least two of the panels relative to each other, said movement comprising lateral movement wherein the centers of said panels move relative to each other;

an RF signal transmitter and/or receiver adapted to respectively transmit and/or receive RF signals through the radiator elements of the panels;

RF transmission lines connecting the RF signal transmitter and/or receiver to the radiator elements; and a controller adapted to mechanically rotate the panels over a range of radiation pattern beam pointing directions, while also moving the panel centers relative to each other such that when viewed from the beam pointing direction of the panels they appear to present a continuous surface without overlap or gaps over at least some range of beam pointing directions, wherein said mechanical mount structure allows and the controller causes overlap of at least two of the panels at a vertical plane for some range of beam pointing directions.

11. The multi panel antenna as in claim 10 wherein said mechanical mount structure rotates said panels and moves the centers of said panels relative to each other as part of a single complex movement.

12. A multi panel antenna comprising:

a plurality of panels, each including a plurality of arrayed antenna radiator elements;

active areas of said panels including differently shaped active areas;

a mechanical mount structure carrying the panels in a manner which allows movement of at least two of the panels relative to each other;

an RF signal transmitter and/or receiver adapted to respectively transmit and/or receive RF signals through the radiator elements of the panels;

RF transmission lines connecting the RF signal transmitter and/or receiver to the radiator elements; and a controller adapted to mechanically move the panels over a range of radiation pattern beam pointing directions.

13. A multi panel antenna as in claim 12 wherein said controller is adapted to move the panels relative to each other such that when viewed from the beam pointing direction of the panels they appear to present a continuous surface without overlap or gaps over at least some range of beam pointing directions.

14. A multi panel antenna as in claim 12 wherein all of said active areas are tapered to smaller dimensions at edges thereof.

15. A multi panel antenna as in claim 12 wherein a first of said panels has a generally oval shape and at least one other of said panels has a generally crescent shape which mates with said first panel and/or other crescent-shaped panels to provide a composite generally oval shape when their projections are viewed along said radiation pattern beam pointing directions.

16. A multi panel antenna comprising:

a plurality of panels, each including a plurality of arrayed antenna radiator elements;

a mechanical mount structure carrying the panels in a manner which allows movement of at least two of the panels relative to each other;

an RF signal transmitter and/or receiver adapted to respectively transmit and/or receive RF signals through the radiator elements of the panels;

RF transmission lines connecting the RF signal transmitter and/or receiver to the radiator elements at least some of said transmission lines including time delay elements for introducing time delays, in addition to possible beam steering phase shifts, in transmission lines leading to/from at least some RF radiator elements of said panels and are dimensioned so as to substantially equalize effective signal propagation times to/from a remote signal source/sink and a local signal sink/source; and a controller adapted to mechanically move the panels over a range of radiation pattern beam pointing directions.

17. A multi panel antenna as in claim 16 wherein said controller is adapted to move the panels relative to each other such that when viewed from the beam pointing direction of the panels they appear to present a continuous surface without overlap or gaps over at least some range of beam pointing directions.

18. A multi panel antenna as in claim 16 wherein at least some of said time delays are dimensioned to provide a time delay exceeding plural wavelength periods of the longest wavelength RF signals to be received and/or transmitted by the antenna.

19. A multi panel antenna comprising:

a plurality of panels, each including a plurality of arrayed antenna radiator elements, at least one of said panels having a thickness and/or height dimension different from another panel;

a mechanical mount structure carrying the panels in a manner which allows movement of at least two of the panels relative to each other;

an RF signal transmitter and/or receiver adapted to respectively transmit and/or receive RF signals through the radiator elements of the panels;

RF transmission lines connecting the RF signal transmitter and/or receiver to the radiator elements; and a controller adapted to mechanically move the panels over a range of radiation pattern beam pointing directions, while also moving the panels relative to each other such that when viewed from the beam pointing direction of the panels they appear to present a continuous surface without overlap or gaps over at least some range of beam pointing directions.

20. An RF antenna phased array as in claim 19 wherein, for some beam directions, there is a vertical overlap of at least some of said panels and, for some other beam directions, there is no vertical overlap of said panels.

21. A method of operating a multi panel antenna comprising:

a plurality of panels, each including a plurality of arrayed antenna radiator elements, said method comprising: inducing electrical tilt in a pointing angle of a radiation pattern beam of one or more of the panels as RF signals are communicated via said panels; and mechanically moving the panels over a range of radiation pattern beam pointing directions, while also moving the panel centers relative to each other such that when viewed from the beam pointing direction of the panels they appear to present a continuous surface without overlap or gaps over at least some range of beam pointing directions, said moving comprising lateral movement wherein the centers of said panels move relative to each other and rotational movement over a range of angles, wherein the panels are mechanically moved over a range including an angle in which the beam pointing direction of the panels and a line perpendicular to the panels are in separate quadrants of space when divided by horizontal and vertical lines intersecting at an axis of panel rotation.

22. The method of claim 21 wherein said electrical tilt enables a reduction of the height of said panels to at least 0.7 times the panel height required to achieve the same tilt by mechanical rotation only.

23. A method of operating a multi panel antenna comprising:

a plurality of panels included in each of plural assemblies of panels, the panels in each assembly being physically fixed with respect to each other, each panel including a plurality of arrayed antenna radiator elements, said method comprising: mechanically moving the panel assemblies over a range of radiation pattern beam pointing directions, said moving comprising lateral movement wherein the centers of said assemblies move relative to each other.

24. A method as in claim 23 further comprising:

moving the panel assemblies relative to each other and controlling the respective beam pointing directions of said panels such that when viewed from the beam pointing direction of the panels, they appear to present a continuous surface without overlap or gaps over at least some range of beam pointing directions.

25. A method of operating a multi panel antenna comprising:

a plurality of panels, each including a plurality of arrayed antenna radiator elements, said method comprising: mechanically moving the panels over a range of radiation pattern beam pointing directions, while also moving the panels relative to each other and controlling their respective beam pointing directions such that when viewed from the beam pointing direction of the panels they appear to present a continuous surface without overlap or gaps over at least some range of beam pointing directions, wherein at least two of the panels overlap at a vertical plane for some range of beam pointing directions.

26. A method of operating a multi panel antenna comprising a plurality of panels, each panel comprising respectively differently shaped and/or sized active areas including a plurality of arrayed antenna radiator elements, said method comprising:

mechanically moving the panels over a range of radiation pattern beam pointing directions, while also moving the panels relative to each other such that when viewed from the beam pointing direction of the panels they appear to present a continuous surface without overlap or gaps over at least some range of beam pointing directions.

27. A method as in claim 26 wherein all of said active areas are tapered to smaller dimensions at at least one pair of opposing edges.

28. A method as in claim 26 wherein a first of said panels has a generally oval shape and at least one other of said panels has a generally crescent shape which mates with said first panel and/or other crescent-shaped panels to provide a composite generally oval shape when their projections are viewed along said radiation pattern beam pointing directions.

29. A method as in claim 26 wherein time delays, in addition to beam steering phase shifts, are introduced in transmission lines leading to/from at least some RF radiator elements of said panels and are dimensioned so as to substantially equalize effective signal propagation times to/from a remote signal source/sink and a local signal sink/source.

30. A method as in claim 29 wherein at least some of said time delays are dimensioned to provide a time delay exceeding plural wavelength periods of the longest wavelength RF signals to be received and/or transmitted by the antenna.

31. A method of operating a multi panel antenna comprising a plurality of panels, at least one of said panels having a thickness and/or height dimension different from another panel and each panel including a plurality of arrayed antenna radiator elements, said method comprising:

mechanically moving the panels over a range of radiation pattern beam pointing directions, while also moving the panels relative to each other and controlling their respective beam pointing directions such that when viewed from the beam pointing direction of the panels they appear to present a continuous surface without overlap or gaps over at least some range of beam pointing directions.

32. A method of operating an antenna phased array comprising a plurality of panels, each panel having an active area containing a phased sub-array of plural RF radiator elements for receiving and/or transmitting RF electromagnetic waves with a principal radiation pattern lobe having a pointing angle direction, said method comprising:

mounting each said panel for controlled movements with respect to an antenna mounting base structure with a horizontal distance G between vertical projections of adjacent panel edges; and controlling coordinated movements of the panels and controlling their respective beam pointing directions so that a range of antenna pointing angles is provided wherein projections of the panels along said pointing angle direction of said principle radiation pattern lobe present substantially contiguous edges and an apparently continuous surface even when G becomes negative due to physically overlapping panel edges along a vertical direction over at least some range of beam pointing directions.

33. A method as in claim 32 wherein, for some beam directions, there is a vertical overlap of at least some of said panels and, for some other beam directions, there is no vertical overlap of said panels.

34. A multi panel antenna, comprising:

a plurality of panels, each including a plurality of arrayed antenna radiator elements;

a mechanical mount structure carrying the panels in a manner which allows movement of at least two of the panels relative to each other, wherein said mechanical mount structure comprises a plurality of assemblies such that at least one of said assemblies is configured to pivot at its base;

an RF component comprising one or both of a signal transmitter which transmits and a signal receiver which receives signals through the radiator elements of the panels; and RF transmission lines connecting said RF component to the radiator elements in a manner which is capable of inducing electrical tilt in a pointing angle of a radiation pattern beam of one or more of the panels.

35. A multi panel antenna, comprising:

a plurality of at least four panels, each including a plurality of arrayed antenna radiator elements;

at least two assemblies of the panels, each assembly including at least two panels that are displaced from each other and also fixed in position with respect to each other so that they do not move relative to each other but are movable together as a unit with respect to at least one other panel;

a mechanical mount structure carrying the panel assemblies in a manner which allows movement of at least two of the panel assemblies relative to each other;

an RF component comprising one or both of a signal transmitter adapted to transmit and a signal receiver adapted to receive signals through the radiator elements of the panels;

RF transmission lines connecting said RF component to the radiator elements; and a controller adapted to mechanically move the panel assemblies over a range of radiation pattern beam pointing directions, wherein said controller is adapted to move the panel assemblies relative to each other such that when viewed from the beam pointing direction of the panels they appear to present a continuous surface without overlap or gaps over a multiplicity of angles in the range of possible beam pointing angles.

* * * * *